US005195434A

United States Patent [19]

Hoffman

[11] Patent Number: 5,195,434

[45] Date of Patent: Mar. 23, 1993

[54] TRANSFER PRINTING PRESS

[75] Inventor: Richard Hoffman, Chicago, Ill.

[73] Assignee: M & R Printing Equipment, Inc., Glen Ellyn, Ill.

[21] Appl. No.: 591,729

[22] Filed: Oct. 2, 1990

[51] Int. Cl.[5] ..... B41F 15/20

[52] U.S. Cl. ..... 101/126; 101/474

[58] Field of Search ..... 101/114, 115, 126, 474

[56] References Cited

U.S. PATENT DOCUMENTS

| | | | |
|---|---|---|---|
| 3,741,116 | 6/1973 | Green et al. | 101/126 |
| 4,423,676 | 1/1986 | Neel | 101/116 |
| 4,643,093 | 2/1987 | Goar et al. | 101/415.1 |
| 4,766,811 | 8/1988 | Linska | 101/415.1 |

*Primary Examiner*—Edgar S. Burr
*Assistant Examiner*—Christopher A. Bennett
*Attorney, Agent, or Firm*—Wallenstein, Wagner & Hattis, Ltd.

[57] ABSTRACT

An improved transfer printing press of the type having a plurality of beds having a top surface, a device for squeegeeing ink through a screen onto a substrate, a device for curing the ink remaining on the substrate, and a device for drawing air through the bed, wherein the improvement comprises an air permeable material interposed between the top surface of the bed and the substrate to be printed to keep said substrate at a substantially uniform temperature.

8 Claims, 3 Drawing Sheets

TRANSFER PRINTING PRESS

TECHNICAL FIELD OF THE INVENTION

The present invention relates to the field of making transfers. More specifically, the present invention relates to an improved printing press for printing transfers on a substrate.

BACKGROUND OF THE INVENTION

Transfers which are applied to T-shirts and other articles of clothing have become very popular in the last decade. Boutiques which specialize in printing fanciful indicia, such as slogans, college names, or sports team names on T-shirts and other clothing, are commonly seen in shopping malls. The transfers at these boutiques are typically pre-printed on a substrate and are applied by operators at these boutiques to articles of clothing purchased by the consumer with a heat transfer press.

The pre-printed transfers which are applied to clothing are printed on a substrate. The substrate comprises a specialized type of paper which is of conventional design and well-known to those skilled in the art. The transfers consist of indicia from simple one-color block letters to elaborate multi-color illustrations. The transfers also come in various sizes. The transfers are printed in a mirror-image and face down on the substrate, such that when applied to a T-shirt or other article, they become intelligible to those looking at it.

To apply a prepared transfer to an article of clothing, a heated iron or press is typically used. The T-shirt is placed with the portion to be printed face up. The substrate containing the transfer is placed on the T-shirt such that the transfer is in contact with the T-shirt. Heat is then applied to the face of the substrate opposite the transfer, allowing the ink on the substrate to partially melt, and thereby releasing the transfer from the substrate and melting it onto the T-shirt. The T-shirt with the transfer attached is allowed to cool, and is then worn with the transfer attached.

In common use in the industry in making transfers is a multi-station, turret type, transfer printing press. The transfer printing press of this type has a plurality of flat beds or platens spaced along its perimeter. Corresponding to each of these beds is a series of stations whereat a part of the transfer is alternately printed and cured on the substrate. The number of stations employed depends on the number of colors to be printed on the transfer. In the past, the number of operators of the press was also determined by the number of colors to be printed on the transfer. Generally, the more colors to be printed, the more operators are necessary, however, the present press can be operated by two people. Transfers can consist of ten-colors or more.

At the initial station of the typical transfer printing press, the transfer is printed on the substrate on the flat bed or platen. The bed is typically made of metal such as aluminum or stainless steel. A screen embodying the indicia to be printed is pre-made using any conventional means well-known in the art. The indicia or design is formed in the screen by a conventional process. The screen has interstices in the places where ink of a particular color is to be deposited onto the substrate. For each color a different stencilled screen is used.

To print the transfer onto the substrate, the substrate is placed flat on the bed by the operator or an automatic paper feed. The bed typically has a means for creating a vacuum attached to it, and has holes in its top surface to draw air inward through the holes to keep the substrate on the bed by action of the vacuum on the undersurface of the substrate. Once printed with the first color, the substrate must not shift reference or it will be out of registration with the other stations which print the remaining colors.

The stencil screen embodying the indicia is placed over the substrate. Ink of one color is then flooded onto the screen and printed on the substrate by conventional means. The ink is of the type well-known in the industry for making transfers. After the ink is flooded onto the substrate, the ink is squeegeed through the screen onto the substrate leaving ink of the desired color on the substrate where the interstices in the screen appeared. The squeegee is of any type well-known in the art.

After the ink is squeegeed through the screen onto the substrate and the screen is lifted, the turret type machine is rotated to allow the vacuum bed to index to the next station where the ink is then gelled onto the substrate. The ink is cured or gelled on the substrate by any means such as heating it to a critical temperature. Heat is commonly applied by heat curing source directed toward the bed and substrate, though it may be by any known means. The temperature during the curing process must be kept within a window suitable for the ink-curing conditions, typically between 90° to 125° F. The bed, as it is made of metal, tends to act as a heat sink, retaining heat from the successive curing steps. If the temperature of the bed or substrate is allowed to go too high, the substrate has a tendency to scorch or burn, thereby ruining the transfer, and increasing waste and production costs. Furthermore, if the temperature is allowed to go too high, the ink will over-gel, also ruining the transfer. If the temperature is too low, the ink will not cure properly, and will not adhere to the substrate and may adhere to the screen at the next print station. The transfer must be flexible to conform to the shape of the article on which it is to be printed. The transfer must also be cured and dried uniformly. If it is not, there will be irregularities in the transfer, and it will have a tendency to peel off of the substrate at the irregularities.

The above process is repeated for every color to be contained in the transfer. The substrate is pre-shrunk as it comes from the manufacturer, i.e., all moisture is removed from it. The substrate has a tendency to expand when subjected to atmospheric conditions, especially when subjected to humidity. Thus, it is important that each color of the transfer must be applied to a substrate before it changes dimensions.

Furthermore, heat buildup may occur on the bed and substrate, thus interfering with the inking and drying process. The substrate would also have a tendency to burn quicker as a result of the heat buildup. If the heat buildup is too severe, it may require stopping the printing process to allow the bed and substrate to cool. This requires additional time which significantly slows down the production process.

A need has developed for an improved transfer printing press which will allow for removal of the heat applied to the substrate so that it may be controlled, thereby reducing the likelihood of burning the substrate while drying or altering the dimensional characteristics from one printing station to the next. Another need has developed for a transfer printing press which will be operable by a reduced number of persons. A further need has developed for a printing press which will reduce the time the substrate is exposed to the atmosphere before the complete transfer is printed on it, keeping dimensional integrity throughout the printing process, and thereby reducing production time and costs and increasing registration quality. The transfer printing press of the present invention solves these and other problems.

SUMMARY OF THE INVENTION

The present invention is an improved transfer printing press of the type having a plurality of beds having a top surface, means for squeegeeing ink through a screen onto a substrate, means for curing the ink remaining on the substrate, and means for drawing air through the bed. One of the improvements comprises an air porous material interposed between the top surface of the bed and the substrate to permit the substrate to remain in register and to allow cooling of the substrate to be printed to keep said substrate at a substantially uniform temperature.

In the preferred embodiment of the present invention, the bed has a plurality of holes in its top surface. A vacuum pump is attached to the bed such that air is drawn from the atmosphere inward through the holes in the top surface of the bed. The air porous material separates the top surface of the bed from the substrate, allowing air to be drawn from the atmosphere through the holes in the top surface of the bed. The action of the vacuum draws heat away from the substrate and bed continuously during the transfer printing and drying operation, thereby keeping the bed and substrate at a sufficiently low temperature to keep the substrate from burning. The air porous material, due to its small mass, cannot act as a heat sink caused by curing. Therefore, a wide temperature differential is maintained between the ink and the bed. Moreover, this causes the ink to gel instantly, such that the transfer may be indexed to the succeeding station for additional colors.

Because all colors are dried after each print station, after all the colors are printed, the transfer is a finished product. This eliminates the need for an additional step of drying the transfer and also eliminates space in a plant required for dryers and multiple presses. This also reduces the time the substrate is exposed to the atmosphere, and the resulting possibility of changes in the dimensions of the paper and makes for a more uniform registration of the transfer on the substrate. This also makes it possible to speed up production of the transfers up to approximately 600 per hour.

If additional cooling is needed, an air jet is positioned over the bed such that air is blown onto the substrate, keeping it and the ink cool. This allows air to be drawn over the substrate and bed, cooling the upper surface of the substrate and vacuum bed. A separate cooling unit can be incorporated with the air jet such that the air applied to keep the ink and substrate may be artificially cooled or conditioned if the temperature reaches a certain critical level.

Other advantages and aspects of the invention will become apparent upon making reference to the specification, claims, and drawings to follow.

DETAILED DESCRIPTION OF THE INVENTION

Figure 1:
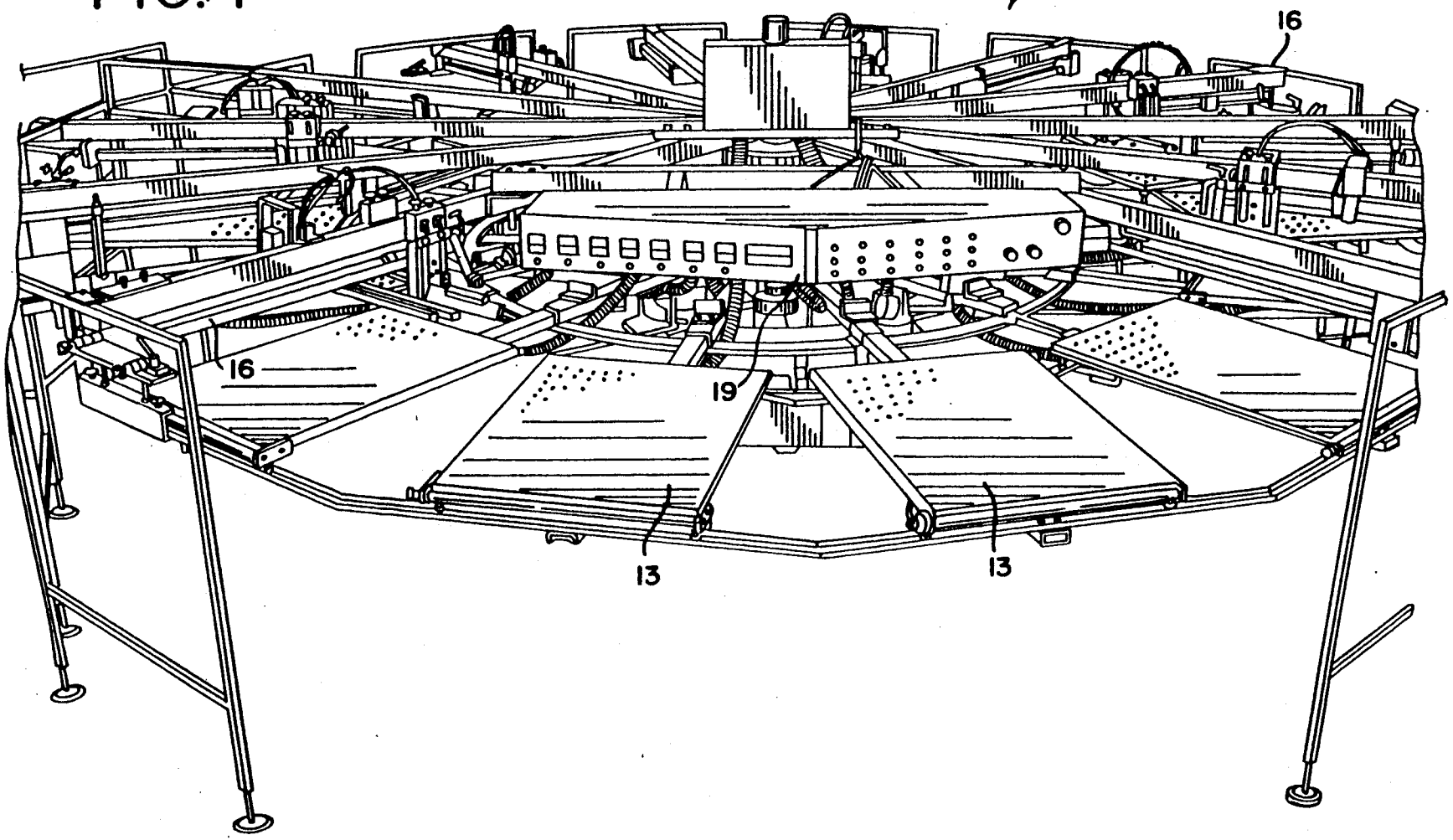
FIG. 1 is a perspective view of the turret-type transfer printing press of the present invention.

While this invention is susceptible of embodiment in many different forms, there is shown in the drawings and will herein be described in detail, a preferred embodiment of the invention with the understanding that the present disclosure is to be considered as an exemplification of the principles of the invention, and is not intended to limit the broad aspect of the invention to the embodiment illustrated.

Referring now to the drawings, FIG. 1 discloses a typical turret-type transfer printing press 10. The press 10 consists of a series of vacuum beds 13 spaced along its perimeter. The vacuum beds 13 are preferably made of a metal such as aluminum or stainless steel. Corresponding to the beds 13 are a series of stations 16. The stations 16 are designed to alternately print and cure transfers. In the middle of the press 10 is a conventional means 19 to rotate the beds 13 between the stations 16 after each print cycle is completed. The loading area is shown in the foreground of FIG. 1.

Figure 2:
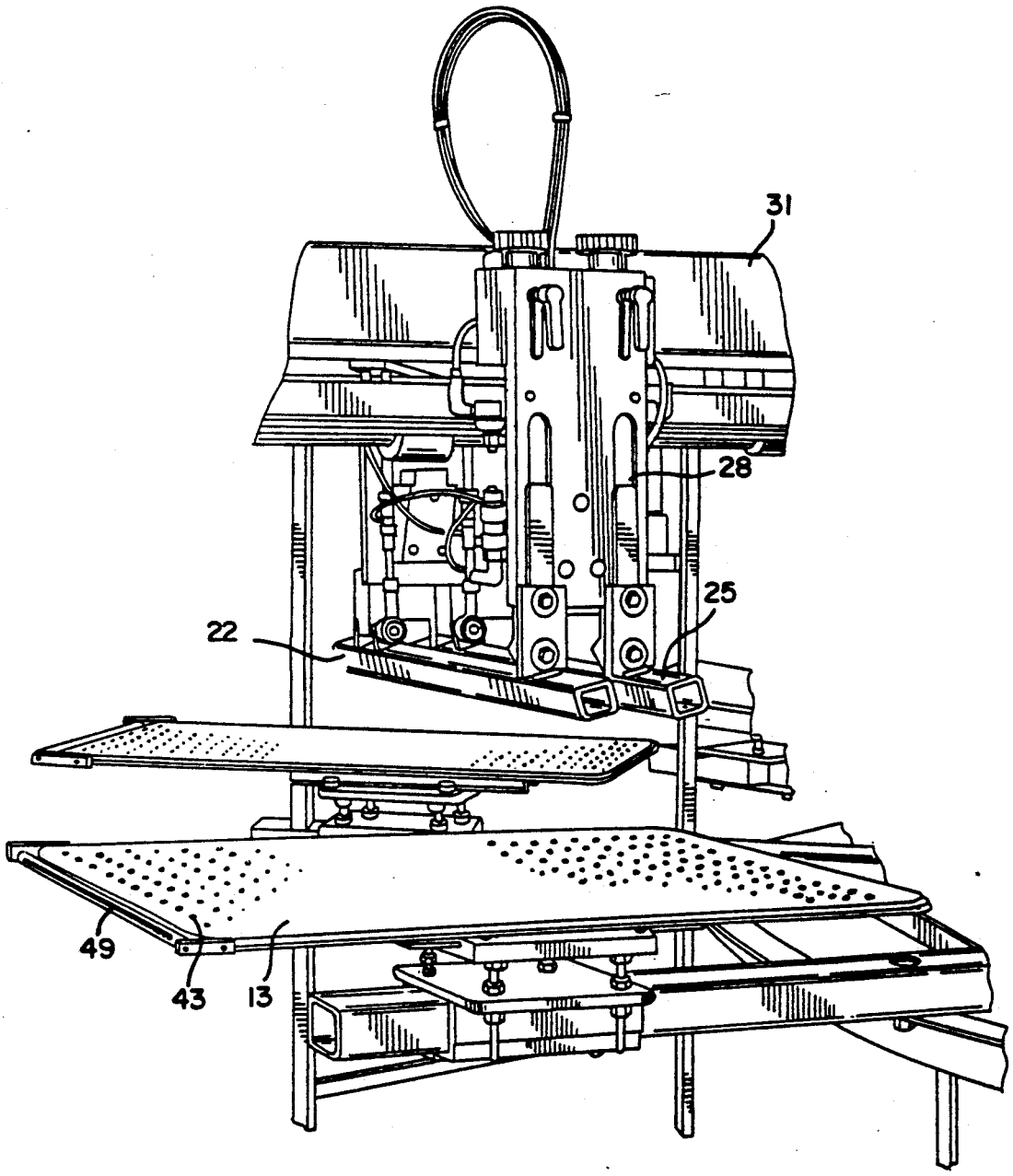
FIG. 2 is an enlarged perspective view of the bed with the flood bar and squeegee holders illustrated without a screen.

FIG. 2 discloses one station 16 of the press 10 designed to print transfers. The station 16 comprises a flood bar 22 and a squeegee 25. The flood bar 22 and squeegee 25 are attached to a housing 28 which slidably engages arm 31. The flood bar 22 and squeegee bar 25 operate to print a transfer on a substrate 34 (FIG. 4) in the conventional manner.

Figure 4:
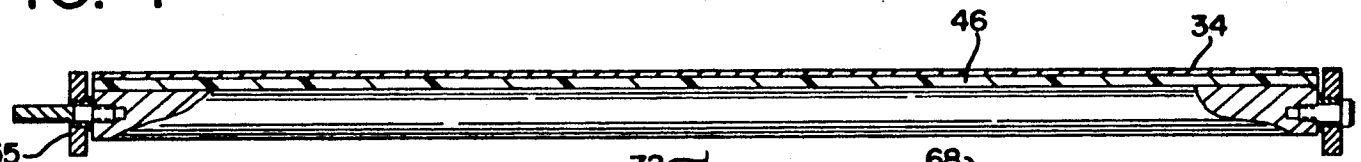
FIG. 4 is a partially cutaway side elevation view of the bed and roller of FIG. 3.

A means for drawing air through the vacuum beds 13 is operatively engaged with each of the beds 13 such that air is drawn inward through a plurality of holes 43 in the top surface of the vacuum beds 13. FIG. 4 discloses an air porous material 46 interposed between the top surface of the bed 13 and the substrate 34. The air porous material 46 is preferably comprised of a porous, fibrous material such as felt, and is approximately 1/32nd of an inch thick. The air porous material 46 preferably covers the entire surface of the vacuum bed 13. On top of the substrate 34 is placed a stencil screen (not shown) which embodies the fanciful indicia to be the subject of the transfer.

Figure 3:
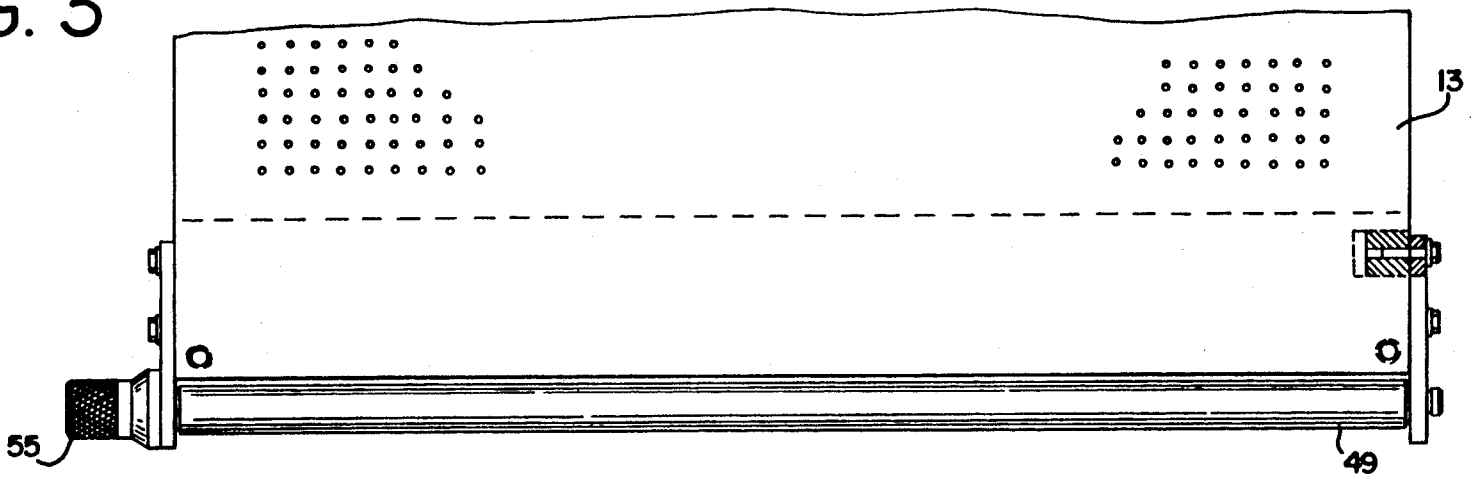
FIG. 3 is a partial top view of the bed with a roller to secure to air porous material to the bed.
Figure 5:
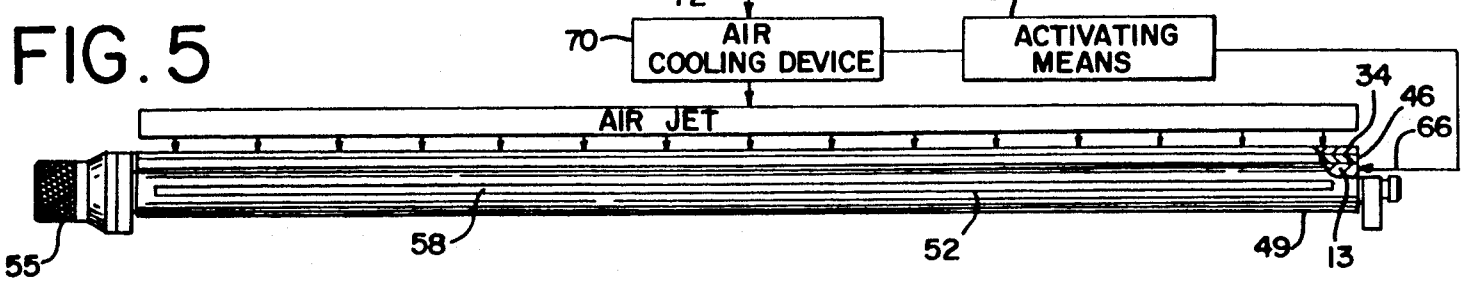
FIG. 5 is a partially cutaway side elevation view of the bed and roller of FIGS. 3 and 4.

FIGS. 3–5 disclose a means for securing the air porous material 46 to the vacuum bed 13. A roller 49 having a longitudinal channel 52 is secured to the outside edge of the bed 13 such that it is parallel with the outside edge. The roller 49 has an eccentric cam 55 which locks upon turning. To secure the air porous material 46 to the bed 13, it is fastened to the inside edge of the bed in any conventional manner. The air porous material 46 is sufficiently long to extend over the roller 49 and cover the longitudinal channel 52. A flat bar is adapted to be press fit in the longitudinal channel 52, and is inserted into the longitudinal channel 52 such that it forces a portion of the air porous material 46 into the channel 52. The cam 55 is then turned and locked to pull the air porous material 46 taut over the bed 13. FIG. 5 shows the air porous material 46 extending straight out and not secured in the longitudinal channel 52.

A means for curing the ink is positioned along the perimeter of the press 10 at an alternate station 16. The drying station is similar to the station 16 disclosed in FIG. 2 except that instead of a flood bar 22 and squeegee bar 25, a drying means, preferably comprising a heating or curing source 63 is positioned along the station. The source is directed such that radiation is shed upon the bed 13 and substrate 34 to heat and cure the ink. The temperature of the substrate 34 must be kept below a critical temperature to prevent burning of the substrate 34. The ink temperature during the gelling process must be kept within a specified window determined by the characteristics of various inks to optimize curing of the ink to the substrate 34. The air porous material 46 serves to separate the substrate 34 from the bed 13 to allow air to be drawn over them through the bed 13. The action of the air over the bed 13 and substrate 34 convect away from them heat generated by heater during curing of the ink. This serves to keep the bed 13 and substrate 34 from overheating, and to keep the ink in the optimal temperature range for curing or gelling.

If further cooling is required or desired, an air jet 61 fed by an airline 64 is positioned above the bed 13 to blow air onto the ink screen, the bed 13 and substrate 34. This serves to further cool the ink, bed 13 and substrate 34 to prevent overheating and burning of the substrate 34. Additionally, a cooling unit may be employed to blow cooled air on the bed 13 and substrate 34 through the air jet 61. This would be especially useful when the temperature of the bed 13 and substrate 34 reach close to the critical temperature, and rapid cooling is necessary. Means for sensing the temperature of the ink and bed 13 may be used to automatically activate the cooling unit to blow cooled air through the air jet 61 when the temperature of the bed 13 or the ink reach a critical temperature. Such a system is shown schematically in FIG. 5. A temperature sensor 66 of conventional type governs actuating means 68 to selectively actuate an air cooling device 70 receiving air from line 72 and passing it to line 64. The air jet may be moved out of the way of ordinary means well known to the art to facilitate access to the substrate 13.

While the specific embodiments have been illustrated and described, numerous modifications come to mind without significantly departing from the spirit of the invention, and the scope of protection is only limited by the scope of the accompanying claims.

I claim:

1. An improved transfer printing press of the type having a plurality of beds movable between at least one printing station and at least one curing station and having a top surface and outside edges, means for squeegeeing ink through a screen onto a substrate at said printing station, heating means for curing the ink remaining on the substrate at said curing station, and means for drawing outside air through said top surface of said bed, wherein the improvement comprises means for maintaining said substrate at a given substantially uniform temperature at said curing station and including an air porous material interposed between the top surface of the bed and the substrate to be printed to permit the flow of outside air through said air porous material.

2. The transfer printing press of claim 1 wherein said air porous material is a napped material.

3. The transfer printing press of claim 1 wherein said air porous material is approximately 1/32 of an inch thick.

4. The transfer printing press of claim 1 further comprising means for securing said air porous material to the bed.

5. The transfer printing press of claim 4 wherein said securing means comprises:

a roller having a longitudinal channel, said roller attached to an outside edge of the bed such that it is parallel with said outside edge of the bed;

means for locking the roller upon turning; and a flat bar adapted to be press fit into said longitudinal channel.

6. The transfer printing press of claim 1 wherein the improvement further comprises means for blowing air onto the top surface of said substrate.

7. The transfer printing press of claim 6 wherein said air blowing means comprises an air jet directed at said substrate.

8. The transfer printing press of claim 7 wherein said air blowing means further comprises;

an air cooling device;

means for sensing the temperature of said bed; and means for activating said air cooling device when the temperature of said bed reaches a critical level.

* * * * *